US007621418B2

(12) United States Patent
Chang

(10) Patent No.: US 7,621,418 B2
(45) Date of Patent: Nov. 24, 2009

(54) CAP FOR VESSEL FOR PERFORMING MULTI-STAGE PROCESS

(75) Inventor: Ronald Chang, Redwood City, CA (US)

(73) Assignee: CEPHEID, Sunnyvale, CA (US)

( * ) Notice: Subject to any disclaimer, the term of this patent is extended or adjusted under 35 U.S.C. 154(b) by 139 days.

(21) Appl. No.: 11/304,798

(22) Filed: Dec. 14, 2005

(65) Prior Publication Data

US 2006/0169708 A1 Aug. 3, 2006

Related U.S. Application Data

(60) Provisional application No. 60/636,984, filed on Dec. 16, 2004.

(51) Int. Cl.
*B65D 43/18* (2006.01)
*B65D 1/04* (2006.01)

(52) U.S. Cl. ..... 220/259.1; 215/6; 220/259.2

(58) Field of Classification Search ... 220/259.1–259.2; 206/19; 215/6, DIG. 8, 204, 278, 306; 435/293.1
See application file for complete search history.

(56) References Cited

U.S. PATENT DOCUMENTS 3,156,369 A * 11/1964 Bowes et al. ..... 206/222
5,029,718 A * 7/1991 Rizzardi ..... 215/254
5,295,599 A * 3/1994 Smith ..... 215/204
5,325,980 A * 7/1994 Grimm et al. ..... 220/212
5,513,768 A * 5/1996 Smith ..... 220/259.2
6,305,576 B1 * 10/2001 Leoncavallo ..... 222/83.5
RE38,067 E * 4/2003 Gueret ..... 206/222
6,926,138 B1 * 8/2005 Basham et al. ..... 206/222

* cited by examiner

*Primary Examiner*—Anthony D Stashick
*Assistant Examiner*—Shawn M Braden
(74) *Attorney, Agent, or Firm*—Townsend and Townsend and Crew LLP

(57) ABSTRACT

Embodiments of the invention provide a cap for a vessel for performing a multi-stage process for analyzing a sample, such as nested PCR or RT-PCR. In one embodiment, the cap comprises a body configured to be mated to the vessel to enclose a vessel interior, a cap cavity for holding reagents, and a cap cavity control portion that is adjustable with respect to the body between a first-stage position in which the cap cavity is enclosed and fluidicly isolated from the vessel interior and a second-stage position in which the cap cavity is fluidicly coupled with the vessel interior.

12 Claims, 12 Drawing Sheets

CAP FOR VESSEL FOR PERFORMING MULTI-STAGE PROCESS

CROSS-REFERENCES TO RELATED APPLICATIONS

Not Applicable

BACKGROUND OF THE INVENTION

This application relates generally to systems and methods for analyzing a sample for the presence of one or more nucleic acids under closed conditions and, more particularly, to a cap for a vessel used for performing such analyses, especially nucleic acid amplification reactions such as polymerase chain reaction (PCR).

Nucleic acid amplification reactions are crucial for many research, medical, and industrial applications. Such reactions are used in clinical and biological research, detection and monitoring of infectious diseases, detection of mutations, detection of cancer markers, environmental monitoring, genetic identification, detection of pathogens in biodefense applications, and the like, e.g., Schweitzer et al., Current Opinion in Biotechnology, 12: 21-27 (2001); Koch, Nature Reviews Drug Discovery, 3: 749-761 (2004). In particular, polymerase chain reactions (PCRs) have found applications in all of these areas, including applications for viral and bacterial detection, viral load monitoring, detection of rare and/or difficult-to-culture pathogens, rapid detection of bio-terror threats, detection of minimal residual disease in cancer patients, food pathogen testing, blood supply screening, and the like, e.g., Mackay, Clin. Microbiol. Infect., 10: 190-212 (2004); Bernard et al., Clinical Chemistry, 48: 1178-1185 (2002). In regard to PCR, key reasons for such widespread use are its speed and ease of use (typically performed within a few hours using standardized kits and relatively simple and low cost instruments), its sensitivity (often a few tens of copies of a target sequence in a sample can be detected), and its robustness (poor quality samples or preserved samples, such as forensic samples or fixed tissue samples are readily analyzed), Strachan and Read, Human Molecular Genetics 2 (John Wiley & Sons, New York, 1999).

Despite the advances in nucleic acid amplification techniques that are reflected in such widespread applications, there is still a need for further improvements in speed and sensitivity, particularly in such areas as infectious disease detection, minimum residual disease detection, bio-defense applications, and the like.

Significant improvements in sensitivity of PCRs have been obtained by using nested sets of primers in a two-stage amplification reaction, e.g., Albert et al., J. Clin. Microbiol., 28: 1560-1564 (1990). In this approach, the amplicon of a first amplification reaction becomes the sample for a second amplification reaction using a new set of primers, at least one of which binds to an interior location of the first amplicon. While increasing sensitivity, the approach suffers from increased reagent handling and increased risk of introducing contaminating sequences, which can lead to false positives.

Significant improvements in sensitivity and a reduction of false positives have also been obtained by carrying out reactions in closed environments. A drawback of highly sensitive amplification techniques is the occurrence of false-positive test results, caused by inappropriate amplification of non-target sequences, e.g., Borst et al., Eur. J. Clin. Microbiol. Infect. Dis., 23: 289-299 (2004). The presence of non-target sequences may be due to lack of specificity in the reaction, or to contamination from prior reactions (i.e. "carry over" contamination) or to contamination from the immediate environment, e.g., water, disposables, reagents, etc. Such problems can be ameliorated by carrying out amplifications in closed vessels, so that once a sample and reagents are added and the vessel sealed, no further handling of reactants or products takes place. Such operations have been made possible largely by the advent of "real-time" amplifications that employ labels that continuously report the amount of a product in a reaction mixture.

Some processes such as nested PCR involve two processes performed in sequence. For instance, a conventional nested PCR procedure utilizes two sequential amplification processes, which include a first round reaction for amplifying an extended target sequence with outer primers, and a second round reaction for amplifying an internal sequence from the product of the first round reaction with inner primers. The internal sequence may or may not overlap with one of the ends of the extended sequence. The enhanced sensitivity of the nested PCR is achieved by carefully controlling the reaction conditions for the first and second amplification processes to favor the generation of the desired product. Unfortunately, the high sensitivity provided by the nested PCR procedures is achieved at the price of potential false positives as the reaction tubes containing high concentrations of the first amplicons have to be opened and manipulated to set up the second amplification, thereby introducing the chance of contamination, which is a significant cause of false-positive results and diminishes the reliability of the analysis.

BRIEF SUMMARY OF THE INVENTION

Embodiments of the present invention provide a cap for a vessel and a method for performing a multi-stage reaction for analyzing a sample, such as a two-stage PCR process, e.g., a nested PCR process or a reverse transcription polymerase chain reaction (RT-PCR). The cap advantageously permits the multi-stage reaction to be carried out without the need to open the vessel or expose its contents to the outside environment in between the stages of the reaction, thus significantly reducing the risk of contamination.

According to one aspect, the present invention provides a multi-stage process for reacting a sample in a vessel. The vessel is configured to receive a cap to enclose a vessel interior. The cap includes a body and a cap cavity, and the cap is adjustable between a first stage position in which the cap cavity is fluidicly isolated from the vessel interior and a second stage position in which the cap cavity is fluidicly coupled with the vessel interior. The method comprises the steps of providing in the vessel interior a sample mixed with first stage reagents for conducting a first stage reaction, mating the body of the cap to the vessel, and conducting the first stage reaction with the sample and first stage reagents in the vessel interior. The first stage reaction is conducted with the cap in the first stage position in which the cap cavity is fluidicly isolated from the vessel interior. The cap encloses the vessel interior as the first stage reaction is conducted. The method further comprises the step of adding second stage reagents stored in the cap cavity to the reaction product of the first stage reaction. The second stage reagents are added by moving the cap into the second stage position in which the cap cavity is fluidicly coupled with the vessel interior and mixing the second stage reagents with the reaction product of the first stage reaction. A second stage reaction is then conducted in the vessel interior with the reaction product of the first stage reaction and the second stage reagents. By maintaining a closed system with the vessel and cap during the transition from the first-stage position to the second-stage position, the danger of contamination is reduced.

In some embodiments, the body includes a closed bottom and an open top, the cap cavity is disposed in the body, and the closed bottom encloses the vessel interior and fluidicly isolates the cap cavity from the vessel interior in the first-stage position. The cap preferably includes a spike cap portion having a top connected to a spike, and the step of moving the cap to the second stage position preferably comprises penetrating the closed bottom with the spike to fluidicly couple the cap cavity with the vessel interior. In the first stage position, the spike is preferably disposed in the cap cavity without penetrating the closed bottom and the spike top portion encloses the cap cavity. In some embodiments, the step of penetrating the closed bottom with the spike comprises pressing a bearing surface of a driver cap portion of the cap against the top of the spike cap portion. In some embodiments, a removable stop is releasably coupled to the spike cap portion in the first-stage position, the removable stop positioning the spike cap portion with respect to the cap cavity to prevent the spike from penetrating the closed bottom in the first-stage position. The removable stop is removed from the spike cap portion to allow the spike to penetrate the closed bottom in the second-stage position.

In some embodiments, the body includes an open cap channel, the cap comprises an apertured pocket portion having the cap cavity with an aperture, and the aperture is open to introduction of the second stage reagents from outside the vessel in a cap cavity loading position. In some embodiments, the apertured pocket portion is moved into the open cap channel of the body until the aperture is enclosed by a side surface of the body to fluidicly isolate the cap cavity from the vessel interior and from outside the vessel in the first-stage position, the apertured pocket portion enclosing the vessel interior in the first-stage position. In some embodiments, the step of moving the cap into the second stage position comprises moving the apertured pocket portion further into the open cap channel of the body from the first-stage position until the aperture is exposed to the vessel interior in the second-stage position, the apertured pocket portion enclosing the vessel interior in the second-stage position. In some embodiments, a removable stop is releasably coupled to the apertured pocket portion in the first-stage position, the removable stop positioning the apertured pocket portion with respect to the open cap channel to prevent the aperture from being exposed to the vessel interior in the first-stage position. The removable stop is removed from the apertured pocket portion prior to moving the cap to the second-stage position to allow the aperture of the apertured pocket portion to be exposed to the vessel interior in the second-stage position.

In some embodiments, the body comprises a base portion having a first bottom wall having a first opening therein, the cap further comprises an inserted portion inserted into the base portion, the cap cavity is disposed in the inserted portion, the inserted portion has a second bottom wall having a second opening therein, and the step of moving the cap into the second stage position comprises rotating the inserted portion with respect to the base portion to align the first and second openings so that the cap cavity is fluidicly coupled to the vessel interior. The rotating step preferably comprises twisting a knob on top of the inserted portion.

According to another aspect, the present invention provides a cap for a vessel. The cap is configured to mate to the vessel to enclose a vessel interior. The cap comprises a body configured to mate to the vessel, a cap cavity, and a cap cavity control portion that is adjustable with respect to the body between a first-stage position in which the cap cavity is fluidicly isolated from the vessel interior and a second-stage position in which the cap cavity is fluidicly coupled with the vessel interior.

In some embodiments, the cap cavity is disposed in the body, the body has a closed bottom and an open top, and the closed bottom fluidicly isolates the cap cavity from the vessel interior in the first-stage position. The cap cavity control portion preferably comprises a spike cap portion having a top connected to a spike, and the spike cap portion is preferably configured such that in the first stage position the spike is disposed in the cap cavity without penetrating the closed bottom and such that the top encloses the cap cavity. In some embodiments, the cap further comprises an upper wall extending upward from the body, and the top of the spike cap portion is substantially aligned with a top edge of the upper wall in the first-stage position. The upper wall preferably partially surrounds the spike cap portion in the first-stage position and includes an open region where the upper wall does not surround the spike cap portion.

In some embodiments, the cap further comprises a spike cap arm, such as a flexible strip, connecting between the spike cap portion and the body at the open region. The cap preferably further comprises a driver cap portion having a bearing surface configured to be pressed against the top of the spike cap portion to move the spike cap portion from the first-stage position to the second-stage position, the spike being configured to penetrate the closed bottom in the second-stage position to fluidicly couple the cap cavity with the vessel interior. In some embodiments, the cap further comprises a driver cap arm, such as a flexible strip, connecting between the driver cap portion and the upper wall. In some embodiments, the cap further comprises a spike cap arm connecting between the spike cap portion and the body, wherein the spike cap arm and the driver cap arm are disposed generally opposite from one another.

In some embodiments, the cap further comprises a removable stop releasably coupled to the spike cap portion, the removable stop positioning the spike cap portion with respect to the cap cavity to prevent the spike from penetrating the closed bottom in the first-stage position. The removable stop is removed from the spike cap portion to allow the spike to penetrate the closed bottom in the second-stage position. In some embodiments, the cap cavity control portion is further adjustable with respect to the body to place the cap cavity in a loading position in which the cap cavity is open to receive reagents from outside the vessel. In some embodiments, the cap further comprises a locking member coupled to a side of the body, the locking member being configured to lock the body to the vessel. In some embodiments, the cap cavity contains second stage reagents (e.g., in dried or lyophilized form) for performing a second stage reaction after a first stage reaction is performed in the vessel interior.

In some embodiments, the body includes an open cap channel, and the cap cavity control portion comprises an apertured pocket portion having the cap cavity with an aperture. The apertured pocket portion is inserted partially into the open cap channel of the body with the aperture open to introduction of reagents from outside the vessel in a cap cavity loading position. The apertured pocket portion is movable further into the open cap channel of the body from the cap cavity loading position until the aperture is enclosed by a side surface of the body to fluidicly isolate the cap cavity from the vessel interior and from outside the vessel in the first-stage position. The apertured pocket portion is movable further into the open cap channel of the body from the first-stage position until the aperture is exposed to the vessel interior in the second-stage position. In some embodiments, a removable stop is releasably coupled to the apertured pocket portion, the removable stop positioning the apertured pocket portion with respect to the open cap channel to prevent the aperture from being exposed to the vessel interior in the first-stage position. The apertured pocket portion is preferably configured to enclose the vessel interior in the first-stage position and in the second-stage position.

In some embodiments, the body comprises a base portion having a first bottom wall having a first opening therein, the cap cavity control portion comprises an inserted portion inserted into the base portion, the cap cavity is disposed in the inserted portion, the inserted portion has a second bottom wall having a second opening therein, and the inserted portion is rotatably adjustable with respect to the base portion to misalign the first and second openings in the first-stage position so that the cap cavity is fluidly isolated from the vessel interior and to align the first and second openings in the second-stage position so that the cap cavity is fluidicly coupled to the vessel interior. In some embodiments, the cap further comprises a knob on top of the inserted portion for rotating the inserted portion.

According to another aspect, the invention provides a cap for a vessel. The cap is configured to mate to the vessel to enclose a vessel interior. The cap comprises a body configured to mate to the vessel, a cap cavity, and control means for switching the cap from a first stage position in which the cap cavity is enclosed and fluidicly isolated from the vessel interior to a second stage position in which the cap cavity is fluidicly coupled with the vessel interior. The cap preferably further comprises means for enclosing the vessel interior in the first-stage position and in the second-stage position.

In some embodiments, the body includes a closed bottom and an open top, and the cap cavity is disposed in the body. The control means preferably comprises a spike which is movable from the first-stage position to the second-stage position to penetrate the closed bottom to fluidicly couple the cap cavity with the vessel interior. The cap is also preferably switchable to a loading position in which the cap cavity is open to receive reagents from outside the vessel. In some embodiments, the cap cavity contains second stage reagents (e.g., in dried or lyophilized form) for performing a second stage reaction after a first stage reaction is performed in the vessel interior.

In some embodiments, the body includes an open cap channel, and the control means comprises an apertured pocket portion having the cap cavity with an aperture. The apertured pocket portion is movable into the open cap channel of the body until the aperture is enclosed by a side surface of the body to fluidicly isolate the cap cavity from the vessel interior and from outside the vessel in the first-stage position. The apertured pocket portion is movable further into the open cap channel of the body from the first-stage position until the aperture is exposed to the vessel interior in the second-stage position. In some embodiments, a removable stop is releasably coupled to the apertured pocket portion, the removable stop positioning the apertured pocket portion with respect to the open cap channel to prevent the aperture from being exposed to the vessel interior in the first-stage position. The apertured pocket portion is preferably configured to enclose the vessel interior in the first-stage position and in the second-stage position.

In some embodiments, the body comprises a base portion having a first bottom wall having a first opening therein, the control means comprises an inserted portion inserted into the base portion, the cap cavity is disposed in the inserted portion, the inserted portion has a second bottom wall having a second opening therein, and the inserted portion is rotatably adjustable with respect to the base portion to misalign the first and second openings in the first-stage position so that the cap cavity is fluidly isolated from the vessel interior and to align the first and second openings in the second-stage position so that the cap cavity is fluidicly coupled to the vessel interior. In some embodiments, the cap further comprises a knob on top of the inserted portion for rotating the inserted portion.

The present invention is particularly useful for performing closed-system multi-stage nucleic acid amplification reactions, such as those described in commonly assigned, copending U.S. Patent Application No. 60/622,393 entitled "Closed-System Multi-Stage Nucleic Acid Amplification Reactions," filed Oct. 27, 2004 the entire disclosure of which is incorporated herein by reference.

As used herein, "polymerase chain reaction," or "PCR," means a reaction for the in vitro amplification of specific DNA sequences by the simultaneous primer extension of complementary strands of DNA. In other words, PCR is a reaction for making multiple copies or replicates of a target nucleic acid flanked by primer binding sites, such reaction comprising one or more repetitions of the following steps: (i) denaturing the target nucleic acid, (ii) annealing primers to the primer binding sites, and (iii) extending the primers by a nucleic acid polymerase in the presence of nucleoside triphosphates. Usually, the reaction is cycled through different temperatures optimized for each step in a thermal cycler instrument. Particular temperatures, durations at each step, and rates of change between steps depend on many factors well-known to those of ordinary skill in the art, e.g., exemplified by the references: McPherson et al., editors, PCR: A Practical Approach and PCR2: A Practical Approach (IRL Press, Oxford, 1991 and 1995, respectively). For example, in a conventional PCR using Taq DNA polymerase, a double stranded target nucleic acid may be denatured at a temperature >90° C., primers annealed at a temperature in the range 50-75° C., and primers extended at a temperature in the range 72-78° C. The term "PCR" encompasses derivative forms of the reaction, including but not limited to, RT-PCR, real-time PCR, nested PCR, quantitative PCR, multiplexed PCR, and the like. Reaction volumes range from a few hundred nanoliters, e.g., 200 nL, to a few hundred μL, e.g., 200 μL. "Reverse transcription PCR," or "RT-PCR," means a PCR that is preceded by a reverse transcription reaction that converts a target RNA to a complementary single stranded DNA, which is then amplified, e.g., Tecott et al., U.S. Pat. No. 5,168,038, which patent is incorporated herein by reference. "Real-time PCR" means a PCR for which the amount of reaction product, i.e. amplicon, is monitored as the reaction proceeds. There are many forms of real-time PCR that differ mainly in the detection chemistries used for monitoring the reaction product, e.g., Gelfand et al., U.S. Pat. No. 5,210,015 ("taqman"); Wittwer et al., U.S. Pat. Nos. 6,174,670 and 6,569,627 (intercalating dyes); Tyagi et al., U.S. Pat. No. 5,925,517 (molecular beacons); which patents are incorporated herein by reference. Detection chemistries for real-time PCR are reviewed in Mackay et al., Nucleic Acids Research, 30: 1292-1305 (2002), which is also incorporated herein by reference. "Nested PCR" means a two-stage PCR wherein the amplicon of a first PCR becomes the sample for a second PCR using a new set of primers, at least one of which binds to an interior location of the first amplicon. As used herein, "initial primers" in reference to a nested amplification reaction mean the primers used to generate a first amplicon, and "secondary primers" mean the one or more primers used to generate a second, or nested, amplicon. "Multiplexed PCR" means a PCR wherein multiple target sequences (or a single target sequence and one or more reference sequences) are simultaneously carried out in the same reaction mixture, e.g., Bernard et al., Anal. Biochem., 273: 221-228 (1999) (two-color real-time PCR). Usually, distinct sets of primers are employed for each sequence being amplified. Typically, the number of target sequences in a multiplex PCR is in the range of from 2 to 10, or from 2 to 6, or more typically, from 2 to 4. "Quantitative PCR" means a PCR designed to measure the abundance of one or more specific target sequences in a sample or specimen. Quantitative PCR includes both absolute quantitation and relative quantitation of such target sequences. Quantitative measurements are made using one or more reference sequences that may be assayed separately or together with a target sequence. The reference sequence may be endogenous or exogenous to a sample or specimen, and in the latter case, may comprise one or more competitor templates. Typical endogenous reference sequences include segments of transcripts of the following genes: β-actin, GAPDH, β2-microglobulin, ribosomal RNA, and the like. Techniques for quantitative PCR are well-known to those of ordinary skill in the art, as exemplified in the following references that are incorporated by reference: Freeman et al., Biotechniques, 26: 112-126 (1999); Becker-Andre et al., Nucleic Acids Research, 17: 9437-9447 (1989); Zimmerman et al., Biotechniques, 21: 268-279 (1996); Diviacco et al., Gene, 122: 3013-3020 (1992); Becker-Andre et al., Nucleic Acids Research, 17: 9437-9446 (1989); and the like.

DETAILED DESCRIPTION OF THE INVENTION

Figure 1:
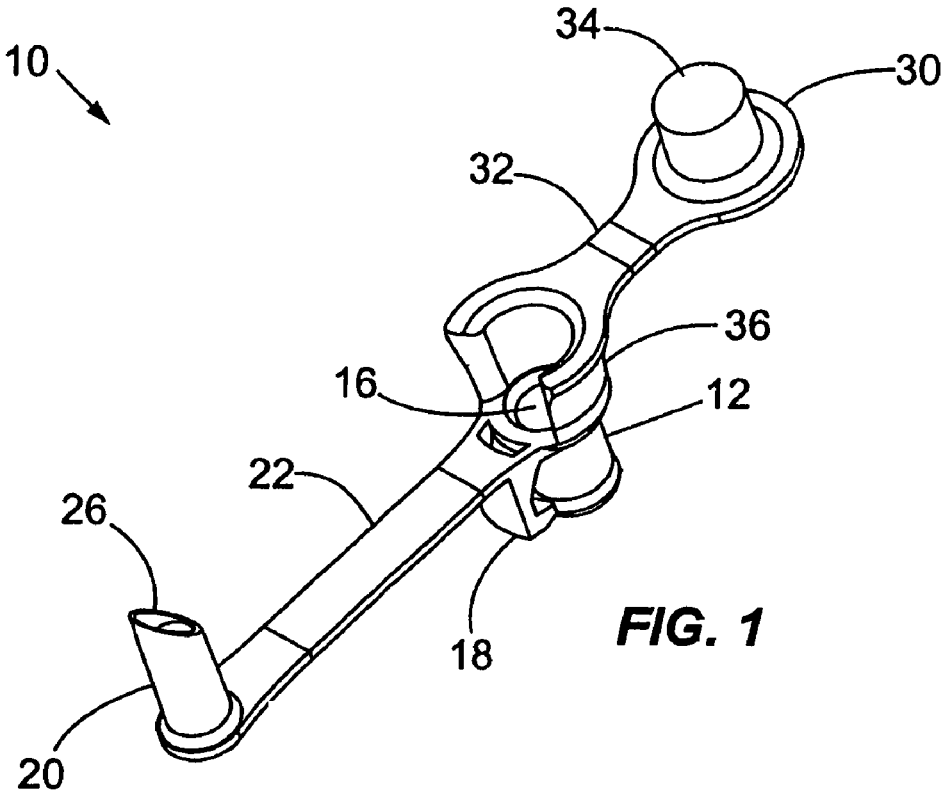
FIG. 1 is an upper perspective view of a cap in an open position having a spike cap portion and a driver cap portion according to an embodiment of the present invention.
Figure 2:
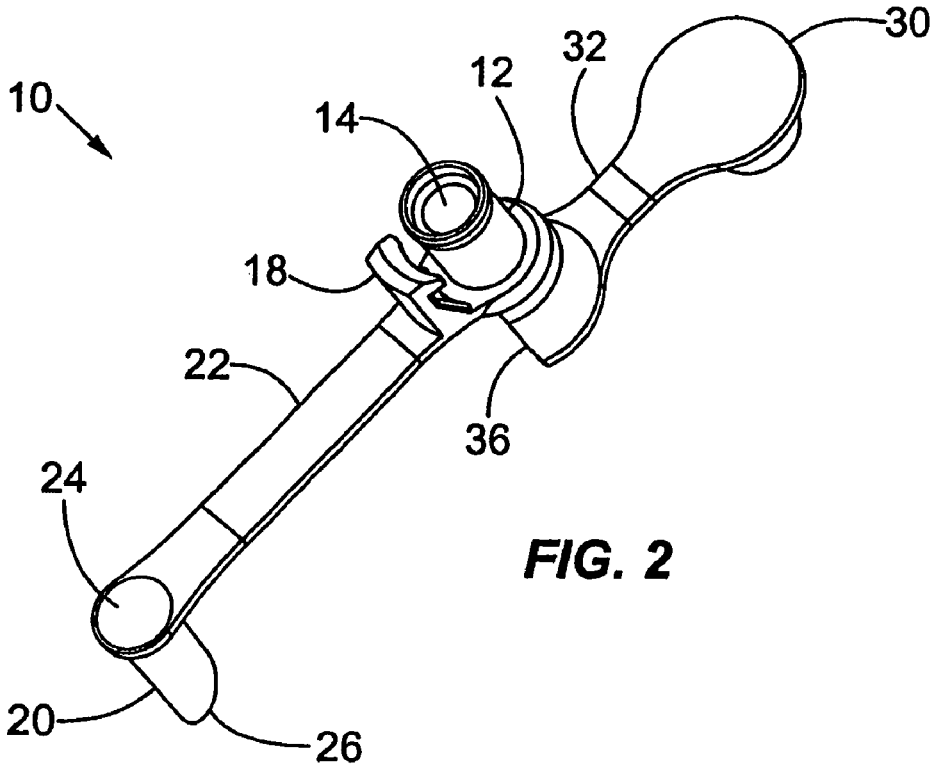
FIG. 2 is a lower perspective view of the cap of FIG. 1.
Figure 3:
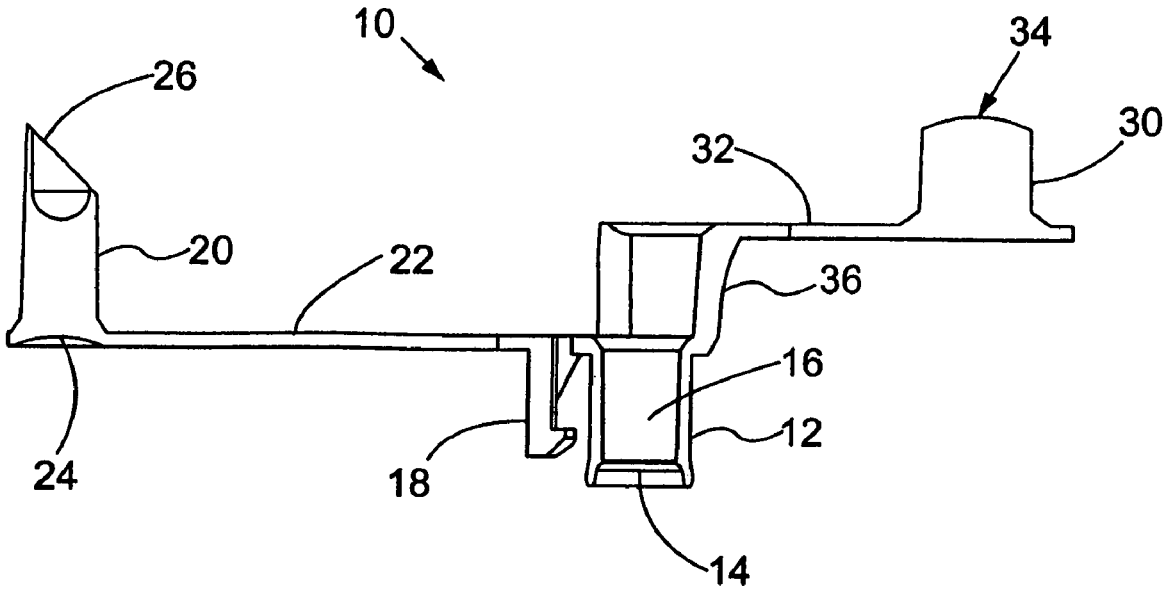
FIG. 3 is a cross-sectional view of the cap of FIG. 1.
Figure 4:
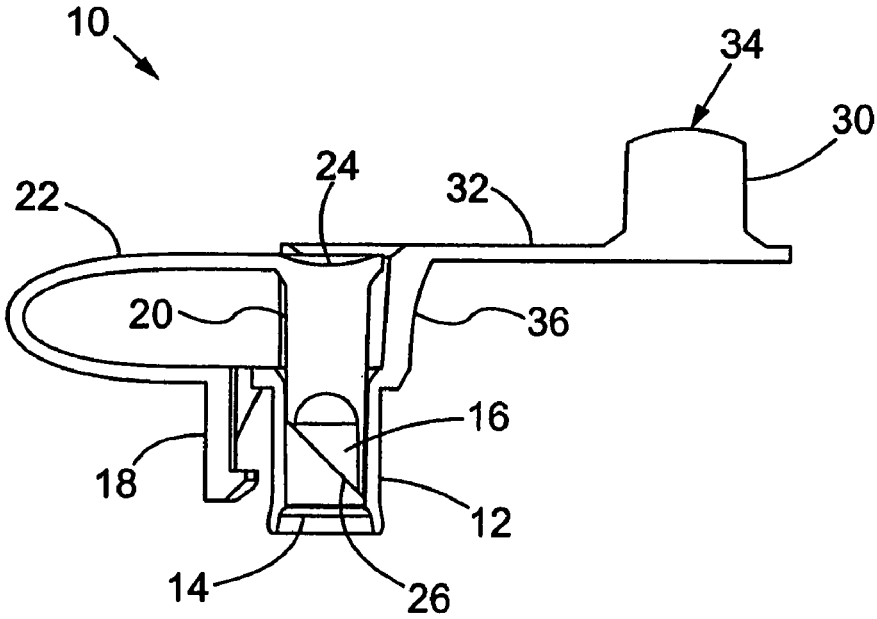
FIG. 4 is a cross-sectional view of the cap of FIG. 1 in a first-stage position.
Figure 5:
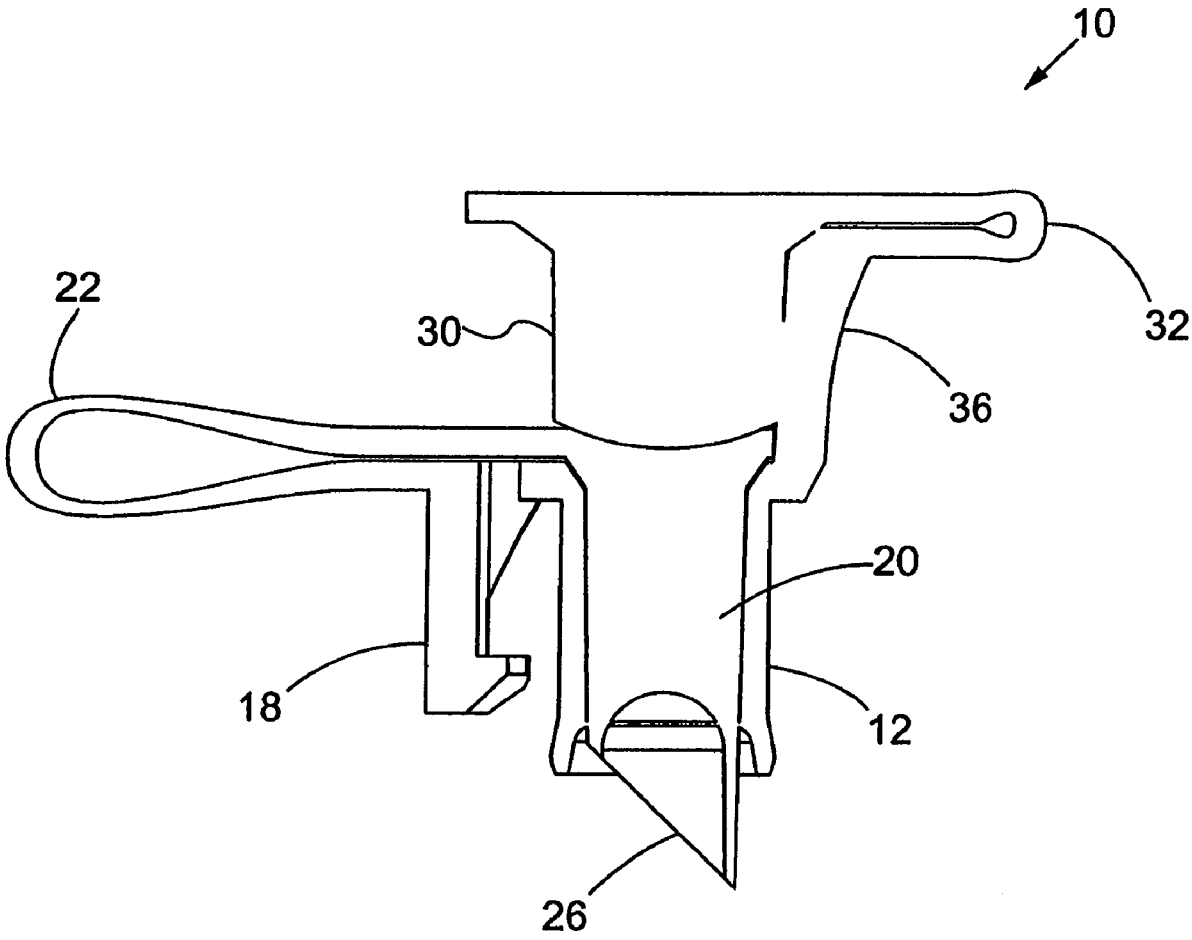
FIG. 5 is a cross-sectional view of the cap of FIG. 1 in a second-stage position.

FIGS. 1-5 show a cap 10 according to a first embodiment of the invention. The cap 10 may be referred to as a booster cap due to the functionality and performance it adds to the nucleic acid analysis device. The cap 10 includes a body 12 having a closed bottom 14 forming a body cavity that serves as a cap cavity 16. The cap cavity 16 is a container for receiving reagents. The reagents may be in liquid form (e.g., an aqueous solution), or dried or lyophilized form (e.g., in the form of a lyophilized bead). A locking member 18 is disposed to the side of the body 12, and may be formed as a hook or the like spaced outwardly from a side of the body 12. A spike cap portion 20 is connected to the body 12 by a spike cap arm 22. The spike cap portion 20 includes a closed top 24 and a spike 26 with a sharp distal end. The spike cap arm 22 is a flexible strip that allows the spike cap portion 20 to be moved between the open position of FIG. 1 and the positions of FIGS. 4 and 5. A driver cap portion 30 is connected to the body 12 by a driver cap arm 32, and includes a bearing surface 34. The driver cap arm 32 is a flexible strip that allows the driver cap portion 30 to be moved between the open position of FIG. 1 and the second-stage position of FIG. 5. The spike cap arm 22 and the driver cap arm 32 may be connected to the body 12 in any suitable manner. In the configuration shown, the spike cap arm 22 is connected to the upper end of the body 12, and the driver cap arm 32 is connected to an upper wall 36 that extends upward from the upper end of the body 12. The upper wall 36 is desirably open in the region where the spike cap arm 22 is connected to the body 12. The driver cap arm 32 is disposed generally opposite from the spike cap arm 22, but the orientation of the arms may be different in other embodiments.

FIGS. 6-9 illustrate the use of the cap 10 for performing a multi-stage reaction for analyzing a sample for the presence of one or more nucleic acids under closed conditions, especially nucleic acid amplification reactions such as polymerase chain reactions (PCRs), which include nested PCR, RT-PCR, and the like. In general, the cap of the present invention may be configured for use with any kind of vessel having a vessel interior (e.g., a reaction chamber) and having an opening (e.g., a port) for adding sample and reagents to the vessel interior. A wide variety of reaction vessels suitable for the method and cap of the present invention are known in the art and/or commercially available (e.g., test tubes, reaction tubes, cartridges, glass capillary tubes, plastic vessels, etc.). In the specific illustrated embodiments, the vessel 50 is the reaction vessel disclosed in commonly owned U.S. Pat. No. 6,369,893 "Multi-Channel Optical Detection System" the disclosure of which is incorporated by reference herein. It is to be understood that there are many other types of reaction vessels known in the art and/or commercially available that are suitable for the cap and method of the present invention, and the scope of the invention is not limited to the particular vessel shown. The cap is configured to mate to the vessel to enclose the vessel interior so that the vessel interior remains closed to the environment outside the vessel during the multi-stage reaction. In the preferred embodiment, the cap 10 has a body that is configured to be inserted into a port of the vessel. It is to be understood, however, that the cap and method of the present invention is not limited to this preferred embodiment. There are many other ways in which the cap may be mated to the vessel to enclose the vessel interior including, but not limited to, the following embodiments: The cap may be screwed onto or into the vessel. The cap may be press fit into, on to, or over the vessel. The cap may be snapped onto, into, or flush to the vessel. The cap may be adhered to, glued to, melted on to, or melted into the vessel.

Figure 6:
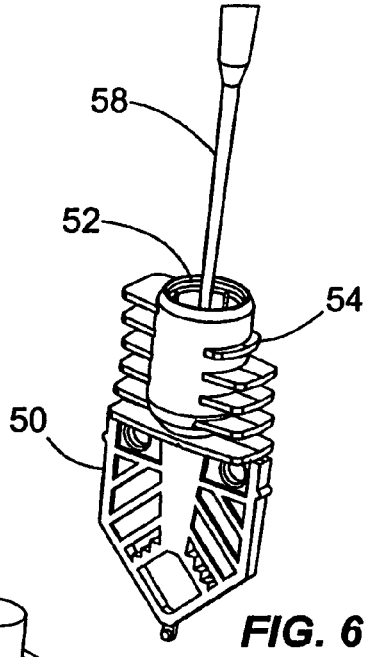
FIG. 6 is a perspective view of a vessel illustrating introduction of a first liquid reagent into the vessel interior prior to placement of the cap.
Figure 7:
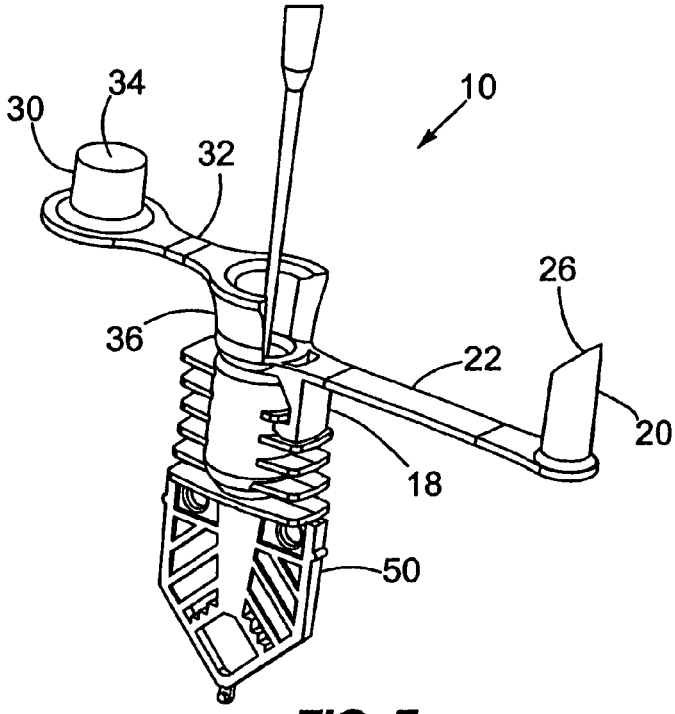
FIG. 7 is a perspective view of the vessel enclosed by the cap of FIG. 1 illustrating introduction of a second liquid reagent into the cap cavity of the cap.
Figure 8:
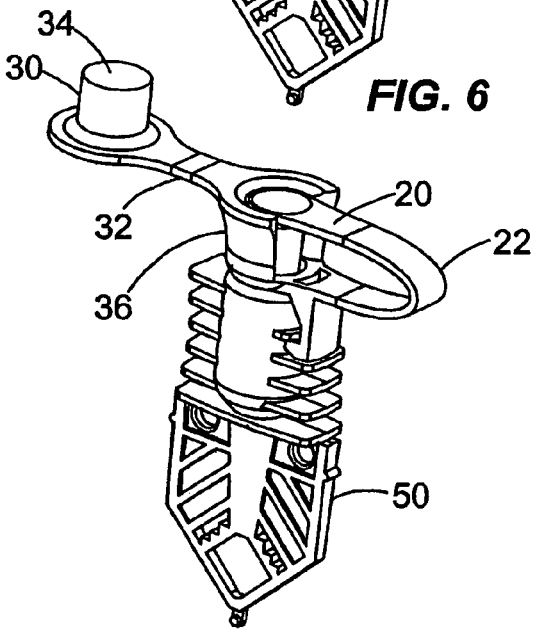
FIG. 8 is a perspective view of the vessel enclosed by the cap of FIG. 1 illustrating closure of the cap cavity by a spike cap portion of the cap in the first-stage position.

In FIG. 6, the vessel 50 has an opening or port 52 to its interior and a ledge or fin 54 configured to engage the locking member 18 of the cap 10. A sample to be analyzed in the multi-stage reaction is introduced into the vessel interior via the port 52 by a tube 58, syringe, pipette, or the like. The sample may be mixed with first stage reagents for performing the first stage of the multi-stage reaction prior to being placed in the vessel interior or the sample may be mixed with the first stage reagents in the vessel interior. For example, the first stage reagents may be stored in the vessel interior in liquid, dried, or lyophilized form so that one merely needs to add the sample to the reagents in the vessel interior and mix. In either case, the first stage reagents should be sufficient for performing the intended first stage reaction with the sample. For example, if the multi-stage reaction is a nested PCR, then the first stage reagents comprises the enzyme and primers necessary to perform the first PCR. As another example, if the intended multi-stage reaction is a RT-PCR, then the first stage reagents are sufficient to perform the reverse transcription. The port 52 is then closed by the cap 10 to provide a closed system within the vessel interior, as seen in FIG. 7. The locking member 18 of the cap 10 preferably engages the fin 54 of the vessel 50 to lock the cap 10 to the vessel 50. This can be done by pushing the cap 10 to mate with the port 52 of the vessel 50 with the locking member 18 and the fin 54 in an offset position (e.g., by 90° offset), and then twisting the cap 10 until the locking member 18 and the fin 54 are engaged together. Optionally, a stopper was placed in the cap cavity 16 and is removed to expose the cap cavity 16 after the cap 10 is coupled with the vessel 10. As shown in FIG. 7, second-stage reagents for conducting a second stage of the multi-stage reaction are introduced from outside the vessel 50 into the cap cavity 16 of the cap 10, which is in a cap cavity loading position. In an alternative embodiment, the second stage reagents are placed in the cap cavity 16 at the time of manufacture so that the end user may skip the step of loading them into the cap cavity 16, since they are pre-loaded. In either case, the second stage reagents should be sufficient for performing the intended second stage reaction with the reaction product of the first stage reaction. For example, if the multi-stage reaction is a nested PCR, then the second stage reagents comprises the enzyme and primers necessary to amplify the nested nucleic acid sequence. As another example, if the intended multi-stage reaction is a RT-PCR, then the second stage reagents are sufficient to perform the PCR amplification of the DNA generated in the reverse transcription reaction of the first stage. The second stage reagents may be in liquid, dried down, or lyophilized form. If the reagents are in dried or lyophilized form, the end-user may add a buffer (e.g., water) to the cap cavity 16 to reconstitute the reagents. In FIG. 8, the spike 26 of the spike cap portion 20 is pushed into the cap cavity 16 to close the cap cavity 16 in a first-stage position. In the first-stage position, the top 24 of the spike cap portion 20 is generally aligned with the top edge of the upper wall 36. The upper wall 36 partially surrounds the spike cap portion 20, desirably by over half of the circumference (i.e., more than 180°). The upper wall 36 has a height which places the top 24 of the spike cap portion 20 at a such a position that the spike 26 does not penetrate the closed bottom 14.

Figure 9:
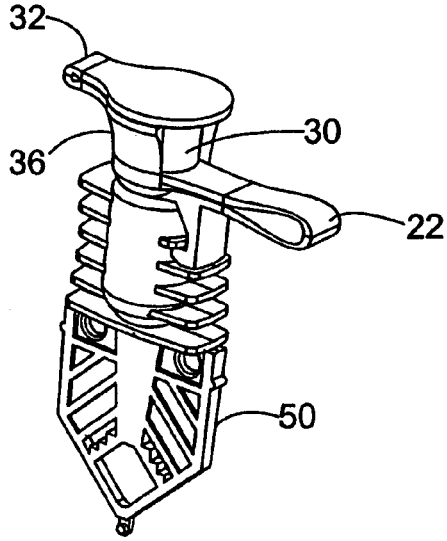
FIG. 9 is a perspective view of the vessel enclosed by the cap of FIG. 1 illustrating delivery of the second liquid reagent from the cap cavity into the vessel interior by closing the driver cap portion in the second-stage position.

In FIG. 9, the bearing surface 34 of the driver cap portion 30 is placed in contact with the closed top 24 of the spike cap portion 20, to push the spike 26 through the closed bottom 14 into the vessel interior and introduce the second liquid reagent into the vessel interior in the second-stage position. The driver cap portion 30 has the height to displace the spike cap portion 26 to the second-stage position to penetrate the closed bottom 14. The upper wall 36 advantageously does not interfere with the downward movement of the spike cap portion 20 and the spike cap arm 22 because the upper wall is open in the region facing the spike cap arm 22. The spike cap portion 20 is movable with respect to the body 12 among the cap cavity loading position of FIG. 7, the first-stage position of FIG. 8, and the second-stage position of FIG. 9.

Figure 10:
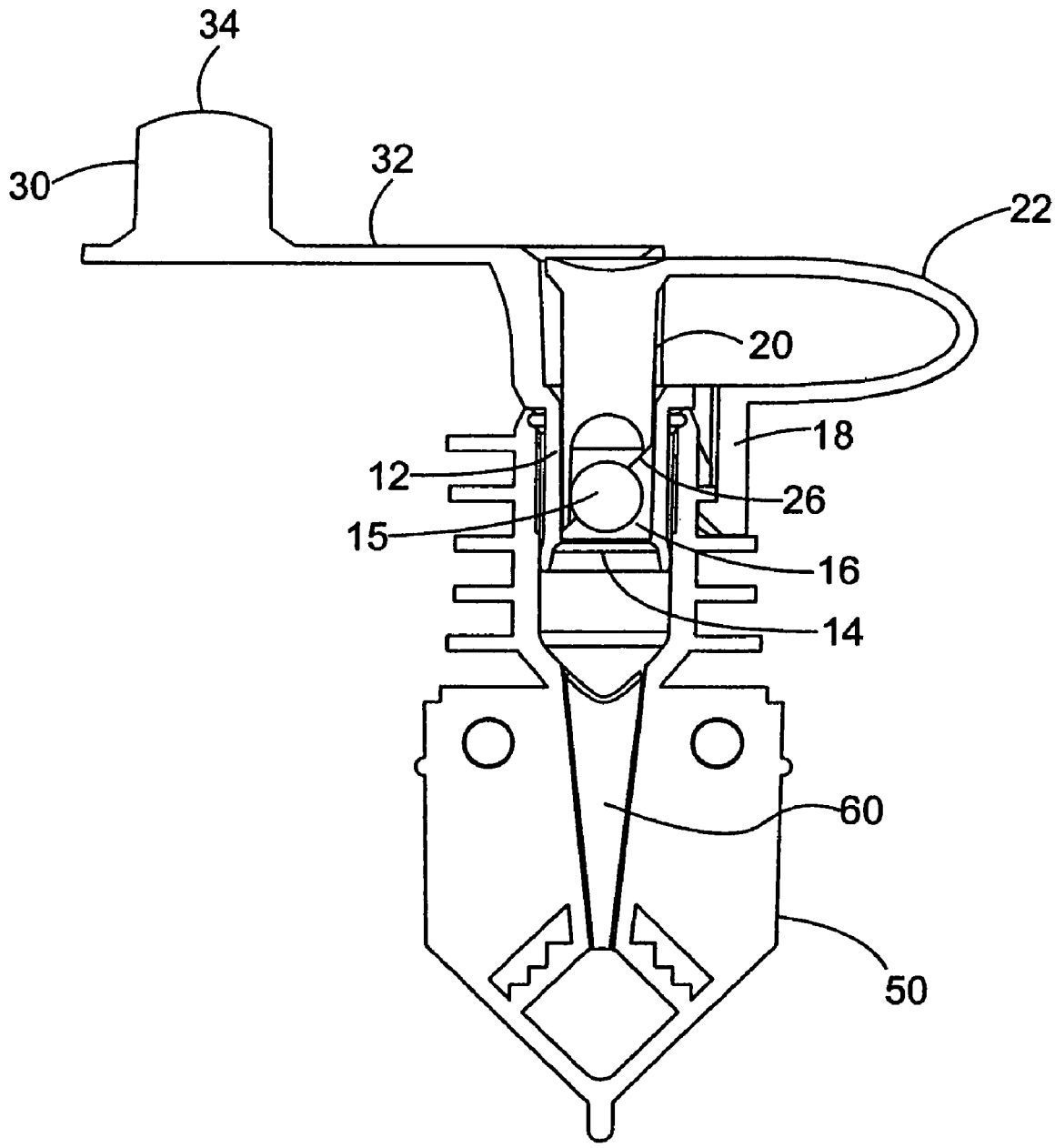
FIG. 10 is a cross-sectional view of the vessel enclosed by the cap in the first-stage position as seen in FIG. 8.

FIG. 10 is a cross-sectional view of the vessel 50 enclosed by the cap 10 in the first-stage position as seen in FIG. 8. The spike 26 of the spike cap portion 20 is disposed in the cap cavity 16, which is fluidicly isolated from the vessel interior 60 by the closed bottom 14. In the first-stage position, the vessel 50 can be used to run the first stage reaction between the first reagent and the sample, such as a first stage PCR reaction or a RT reaction in the closed vessel interior 60. Temperature control systems or thermal cyclers for controlling the necessary reaction temperatures in the vessel are well known in the art.

Figure 11:
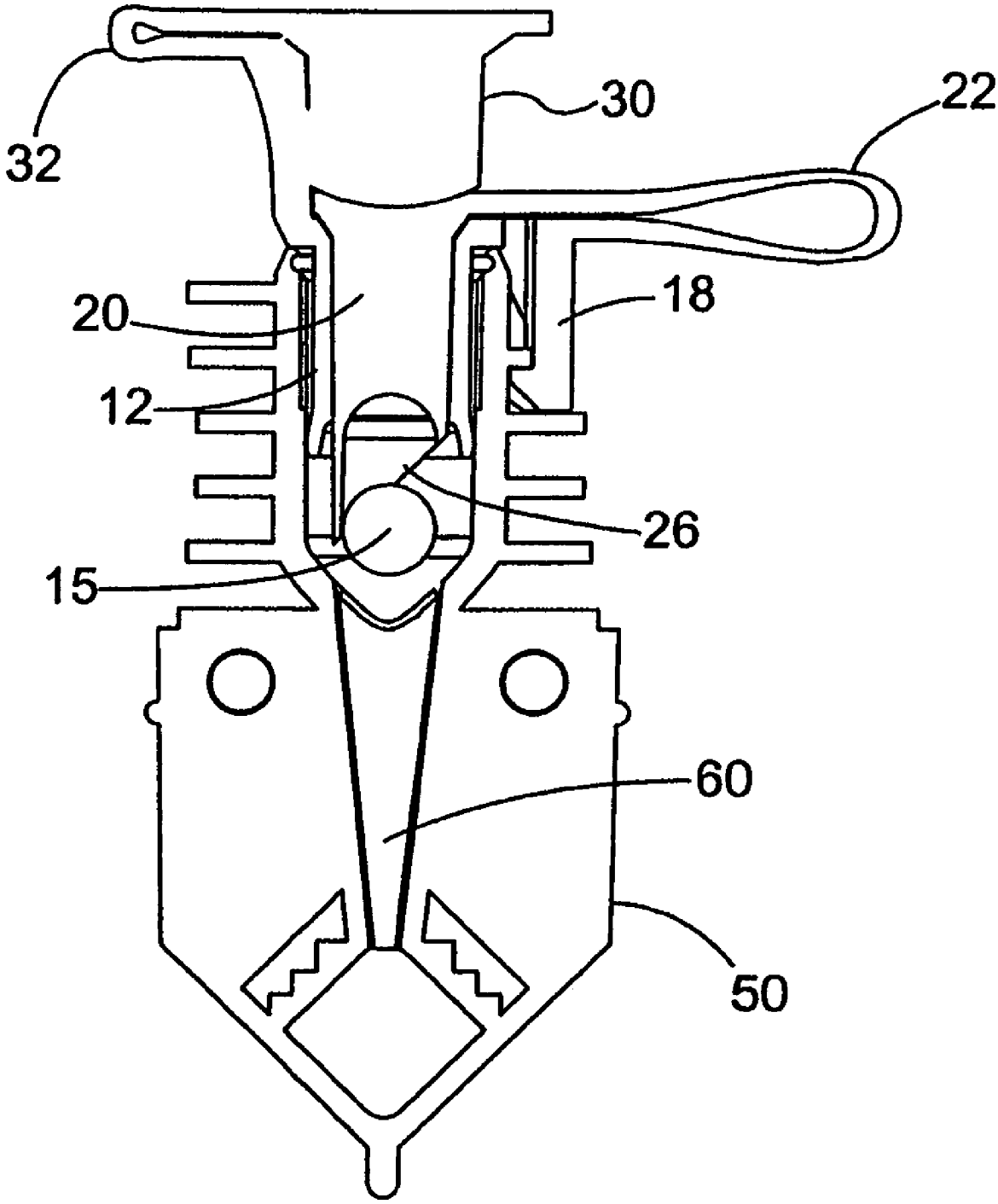
FIG. 11 is a cross-sectional view of the vessel enclosed by the cap in the second-stage position as seen in FIG. 9.

FIG. 11 is a cross-sectional view of the vessel 50 enclosed by the cap 10 in the second-stage position as seen in FIG. 9. The sharp distal end of the spike 26 punctures or breaks the closed bottom 14 of the body 12 and enters the vessel interior 60. This releases the second stage reagents into the vessel interior 60 in the second-stage position. The vessel 50 is typically placed in a spinner or centrifuge apparatus to mix the second stage reagents with the reaction product of the first stage reaction in the vessel interior 60. The vessel 50 can then be used to run the second reaction, such as a second stage PCR reaction in the closed vessel interior 60, by coupling the vessel 50 to a temperature control system (e.g., a thermal cycler). The vessel interior 60 remains a closed system during the transition from the first-stage position to the second-stage position so that there is not a problem with contamination.

Figure 12:
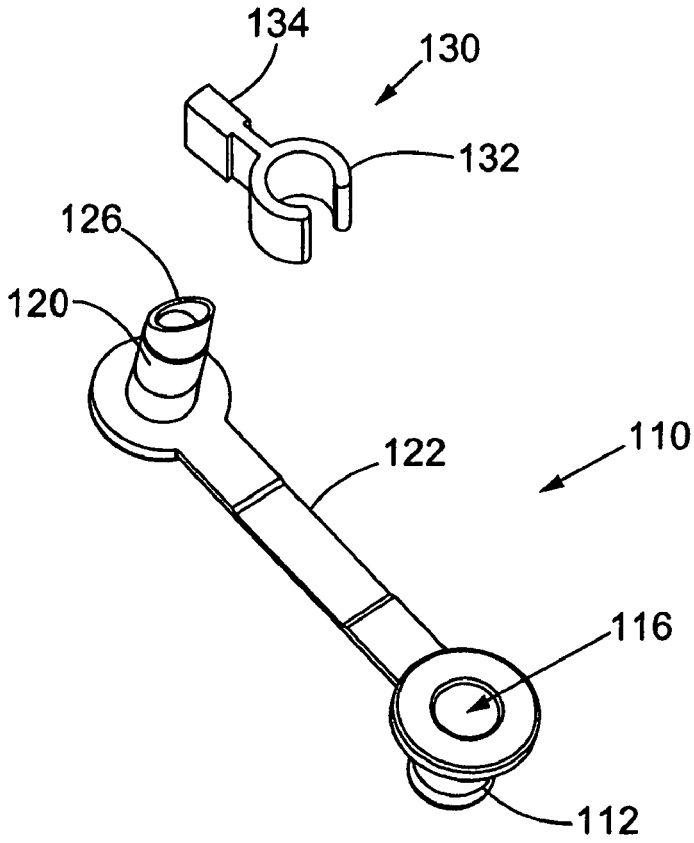
FIG. 12 is an upper perspective view of a cap in an open position having a spike cap portion and a removable stop according to another embodiment of the present invention.
Figure 13:
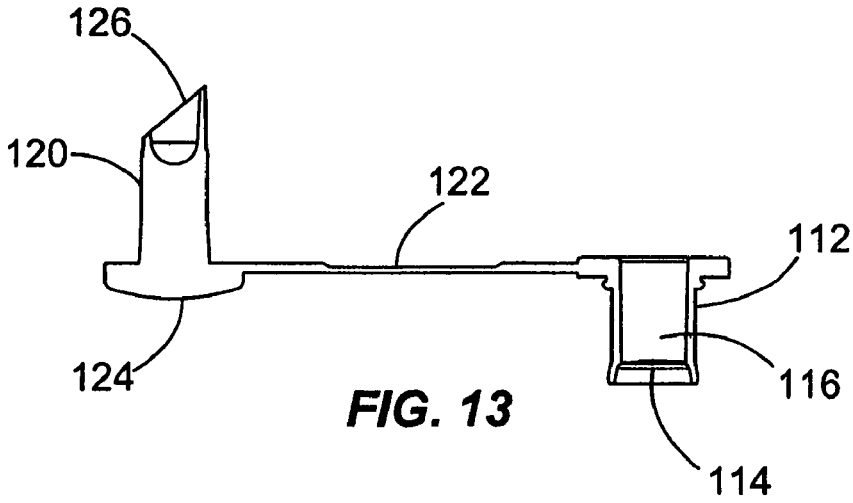
FIG. 13 is a cross-sectional view of the cap of FIG. 12.

In another embodiment as shown in FIGS. 12 and 13, a cap 110 includes a body 112 having a closed bottom 114 and a body cavity which serves as the cap cavity 116. This embodiment does not show a locking member, but one may be provided. A spike cap portion 120 is connected to the body 112 by a spike cap arm 122. The spike cap portion 120 includes a closed top 124 and a spike 126 with a sharp distal end. The spike cap arm 122 is a flexible strip that allows the spike cap portion 120 to be moved between the open position of FIG. 14 and the positions of FIGS. 15 and 16. The spike cap arm 122 may be connected to the body 112 in any suitable manner. In the configuration shown, the spike cap arm 122 is connected to the upper end of the body 112. A removable stop or clip 130 includes a coupling portion 132 and a stop portion 134. The coupling portion 132 is releasably coupled to the spike cap portion 120. In the embodiment shown, the coupling portion 132 is a clip, but other releasable coupling mechanisms may be used in other embodiments.

Figure 14:
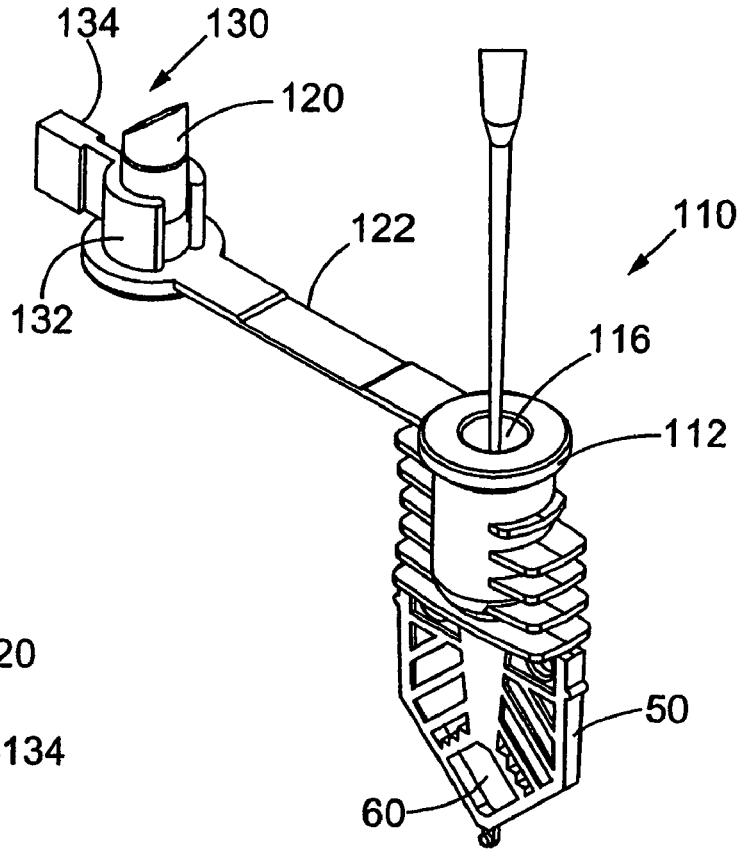
FIG. 14 is a perspective view of the vessel enclosed by the cap of FIG. 12 illustrating introduction of a second liquid reagent into the cap cavity of the cap.
Figure 15:
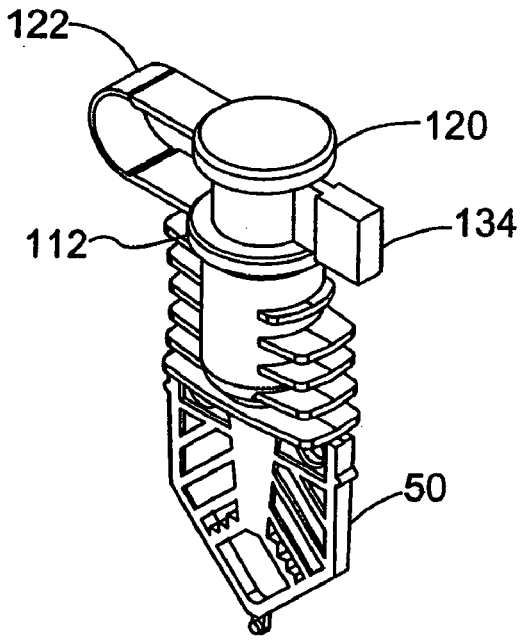
FIG. 15 is a perspective view of the vessel enclosed by the cap of FIG. 12 illustrating closure of the cap cavity by a spike cap portion of the cap supported in the first-stage position by the removable stop.
Figure 16:
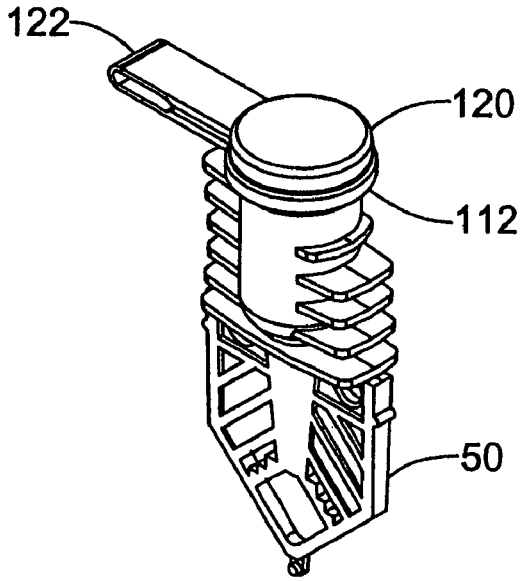
FIG. 16 is a perspective view of the vessel enclosed by the cap of FIG. 12 illustrating delivery of the second liquid reagent from the cap cavity into the vessel interior by removing the removable stop and pushing the spike cap portion to the second-stage position.

FIGS. 14-16 illustrate the use of the cap 110 for performing a two-stage process for analyzing a sample for the presence of one or more nucleic acids under closed conditions. Referring again to the vessel 50 in FIG. 6, a sample to be analyzed in the multi-stage reaction is introduced into the vessel interior via the port 52 by a tube 58, syringe, pipette, or the like. The sample may be mixed with first stage reagents for performing the first stage of the multi-stage reaction prior to being placed in the vessel interior 60 or the sample may be mixed with the first stage reagents in the vessel interior 60. The port 52 is then closed by the cap 110 to provide a closed system within the vessel interior 60, as seen in FIG. 14. In this cap cavity loading position, the second stage reagents are introduced into the cap cavity 116 from outside the vessel 50. In FIG. 15, the spike 126 of the spike cap portion 120 is pushed into the cap cavity 116 to close the cap cavity 116 in a first-stage position. The removable stop 130 spaces the closed top 124 of the spike cap portion 120 from the body 112 of the cap 110 to prevent the spike cap portion 120 from penetrating the closed bottom 114. The removable stop 130 provides a convenient and safe way of positioning the spike cap portion 120 to achieve the first-stage position. The removable stop 130 may be omitted if the user can position the spike cap portion 120 in the first-stage position and avoid penetrating the closed bottom 114 without using the removable stop 130. In FIG. 16, the removable stop 130 is removed from the spike cap portion 120, and the spike cap portion 120 is moved further into the vessel interior 60 from the first-stage position to a second-stage position. In the second-stage position, the spike 126 is pushed through the closed bottom 114 into the vessel interior 60 and releases the second stage reagents into the vessel interior 60. The spike cap portion 120 is movable with respect to the body 112 among the cap cavity loading position of FIG. 14, the first-stage position of FIG. 15, and the second-stage position of FIG. 16.

Figure 17:
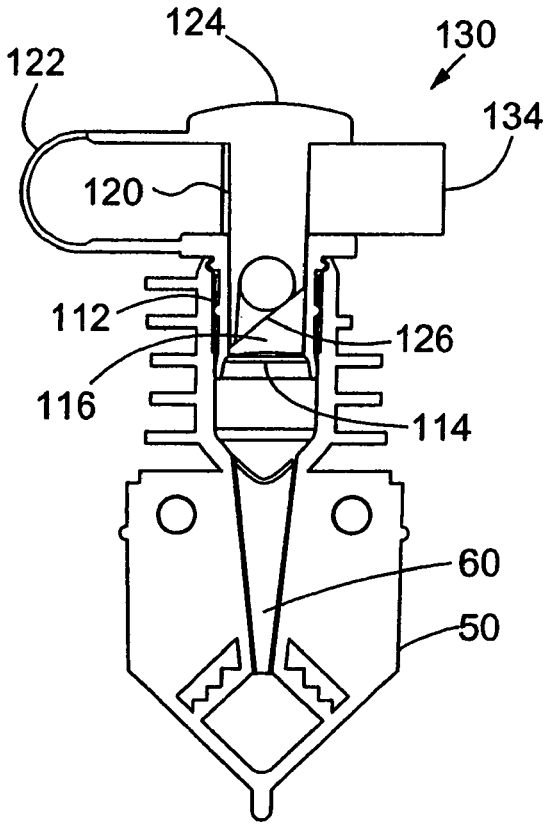
FIG. 17 is a cross-sectional view of the vessel enclosed by the cap in the first-stage position as seen in FIG. 15.

FIG. 17 is a cross-sectional view of the vessel 50 enclosed by the cap 110 in the first-stage position as seen in FIG. 15. The spike 126 of the spike cap portion 120 is disposed in the cap cavity 116, which is fluidicly isolated from the vessel interior 60 by the closed bottom 114. In the first-stage position, the vessel 50 can be used to run the first reaction between the first liquid reagent and the sample, such as a first stage PCR reaction in the closed vessel interior 60, by coupling the vessel 50 to a temperature control system.

Figure 18:
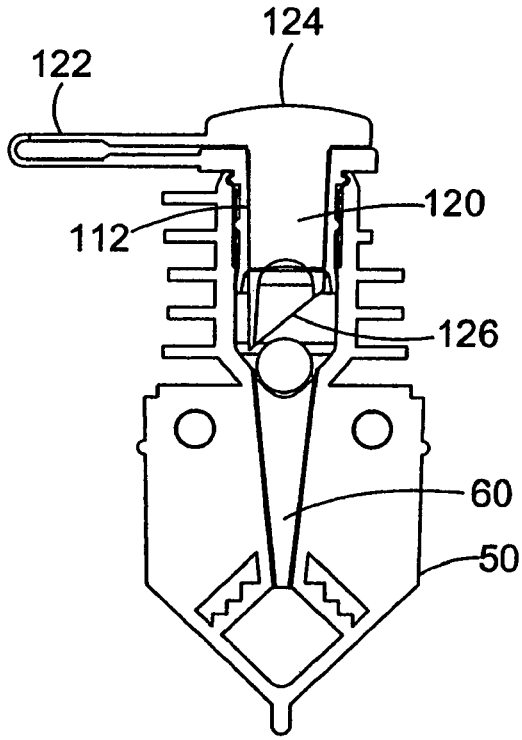
FIG. 18 is a cross-sectional view of the vessel enclosed by the cap in the second-stage position as seen in FIG. 16.

FIG. 18 is a cross-sectional view of the vessel 50 enclosed by the cap 110 in the second-stage position as seen in FIG. 16. The sharp distal end of the spike 126 punctures or breaks the closed bottom 114 of the body 112 and enters the vessel interior 60. This releases the second stage reagents into the vessel interior 60 in the second-stage position. The vessel 50 is typically placed in a spinner or centrifuge apparatus to mix the second stage reagents with the reaction product of the first stage reaction in the vessel interior 60. The vessel 50 can then be used to run the second stage reaction, such as a second stage PCR reaction in the closed vessel interior 60, by coupling the vessel 50 to the temperature control system (e.g., a thermal cycler). The vessel interior 60 remains a closed system during the transition from the first-stage position to the second-stage position.

Figure 19:
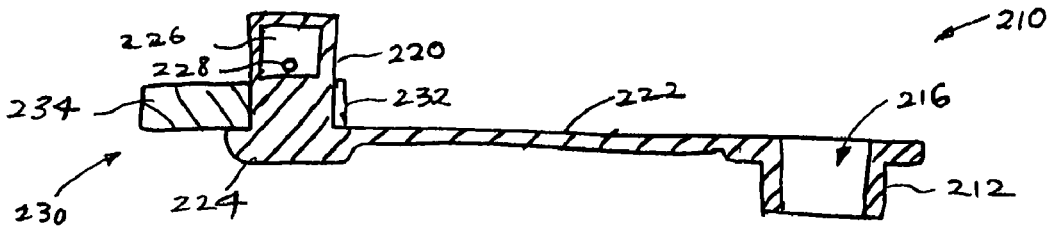
FIG. 19 is a cross-sectional view of a cap having an apertured pocket in an open position according to another embodiment of the present invention.

In another embodiment as shown in FIG. 19, a cap 210 includes a body 212 having an open cap channel 216. This embodiment does not show a locking member, but one may be provided. An apertured pocket portion 220 is connected to the body 212 by a pocket arm 222. The apertured pocket portion 220 includes a closed top 224 and an apertured pocket 226 with an aperture 228 open to the side which allows fluid to be transferred into and out of the apertured pocket 226. The apertured pocket 226 serves as the cap cavity in this embodiment. The pocket arm 222 is a flexible strip that allows the apertured pocket portion 220 to be moved between the open position of FIG. 19 and the positions of FIGS. 20-22. The pocket arm 222 may be connected to the body 212 in any suitable manner. In the configuration shown, the pocket arm 222 is connected to the upper end of the body 212. A removable stop or clip 230 is similar to the removable stop 130 shown in FIG. 12, and includes a coupling portion 232 and a stop portion 234. The coupling portion 232 is releasably coupled to the apertured pocket portion 220.

Figure 20:
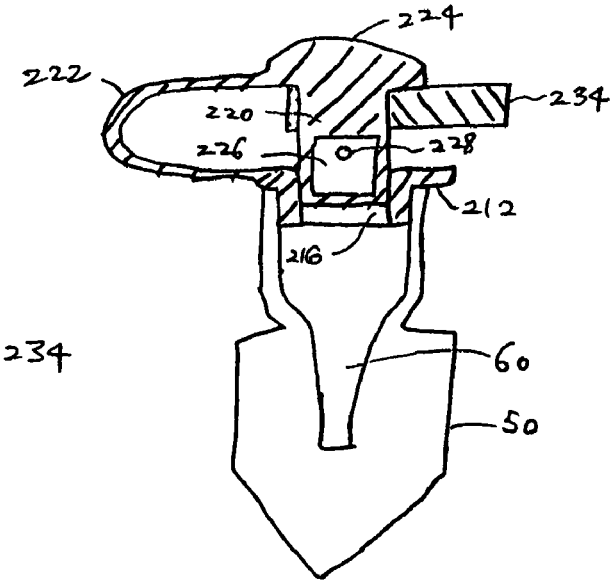
FIG. 20 is a cross-sectional view of the vessel enclosed by the cap of FIG. 19 illustrating introduction of a second liquid reagent into the apertured pocket in a pocket loading position.
Figure 21:
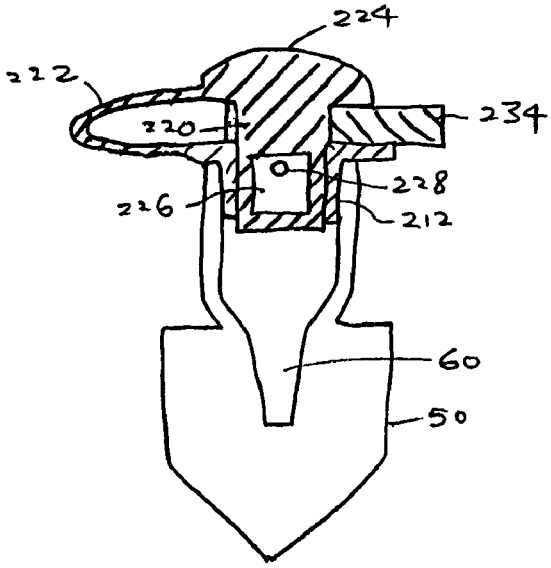
FIG. 21 is a cross-sectional view of the vessel enclosed by the cap of FIG. 19 illustrating closure of the apertured pocket in a first-stage position as supported by a removable stop.
Figure 22:
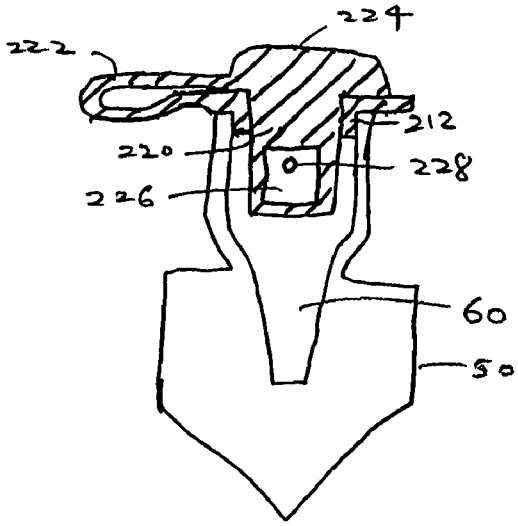
FIG. 22 is a cross-sectional view of the vessel enclosed by the cap of FIG. 19 illustrating delivery of the second liquid reagent from the apertured pocket into the vessel interior by removing the removable stop and pushing the apertured pocket portion to a second-stage position.

FIGS. 20-22 illustrate the use of the cap 210 for performing a two-stage process for analyzing a sample for the presence of one or more nucleic acids under closed conditions. Referring again to the vessel 50 in FIG. 6, a sample to be analyzed in the multi-stage reaction is introduced into the vessel interior via the port 52 by a tube 58, syringe, pipette, or the like. The sample may be mixed with first stage reagents for performing the first stage of the multi-stage reaction prior to being placed in the vessel interior or the sample may be mixed with the first stage reagents in the vessel interior. The port 52 is then closed by the cap 210 to provide a closed system within the vessel interior 60, as seen in FIG. 20. In the pocket or cap cavity loading position of FIG. 20, the aperture 228 is exposed so that the second stage reagents can be introduced into the pocket 226 from outside the vessel 50. As the cap cavity, the pocket 226 has a depth below the aperture 228 to hold the second stage reagents so that they do not spill out through the aperture 228.

In FIG. 21, the apertured pocket portion 220 is pushed further into the cap channel 216. The side surface of the cap channel 216 closes the aperture 228 so that the pocket 226 is fluidicly isolated from the outside and from the vessel interior 60 in a first-stage position. The removable stop 230 spaces the closed top 224 of the apertured pocket portion 220 from the body 212 of the cap 210 to prevent the apertured pocket portion 220 from moving too far into the vessel interior 60. The removable stop 230 may be omitted if the user can position the apertured pocket portion 220 in the first-stage position and avoid moving too far into the vessel cavity 60 without using the removable stop 130.

In FIG. 22, the removable stop 230 is removed from the apertured pocket portion 220, and the apertured pocket portion 220 is moved further into the vessel interior 60 from the first-stage position to a second-stage position. In the second-stage position, aperture 228 is no longer closed by the side of the cap channel 216 but is exposed to the vessel interior 60 since the aperture 228 is spaced from the side surface of the vessel interior 60. This allows the second stage reagents to be introduced into the vessel interior 60. In the first-stage position of FIG. 21, the vessel 50 can be used to run the first reaction between the first liquid reagent and the sample, such as a first stage PCR reaction in the closed vessel interior 60. In the second-stage position, the vessel 50 can be placed in a centrifuge apparatus to mix the second stage reagents with the reaction product of the first stage reaction in the vessel interior 60, and then used to run the second reaction, such as a second stage PCR reaction in the closed vessel interior 60. The apertured pocket portion 220 is movable with respect to the body 212 among the cap cavity loading position of FIG. 20, the first-stage position of FIG. 21, and the second-stage position of FIG. 22. The vessel interior 60 remains a closed system during the transition from the first-stage position to the second-stage position.

Figure 23:
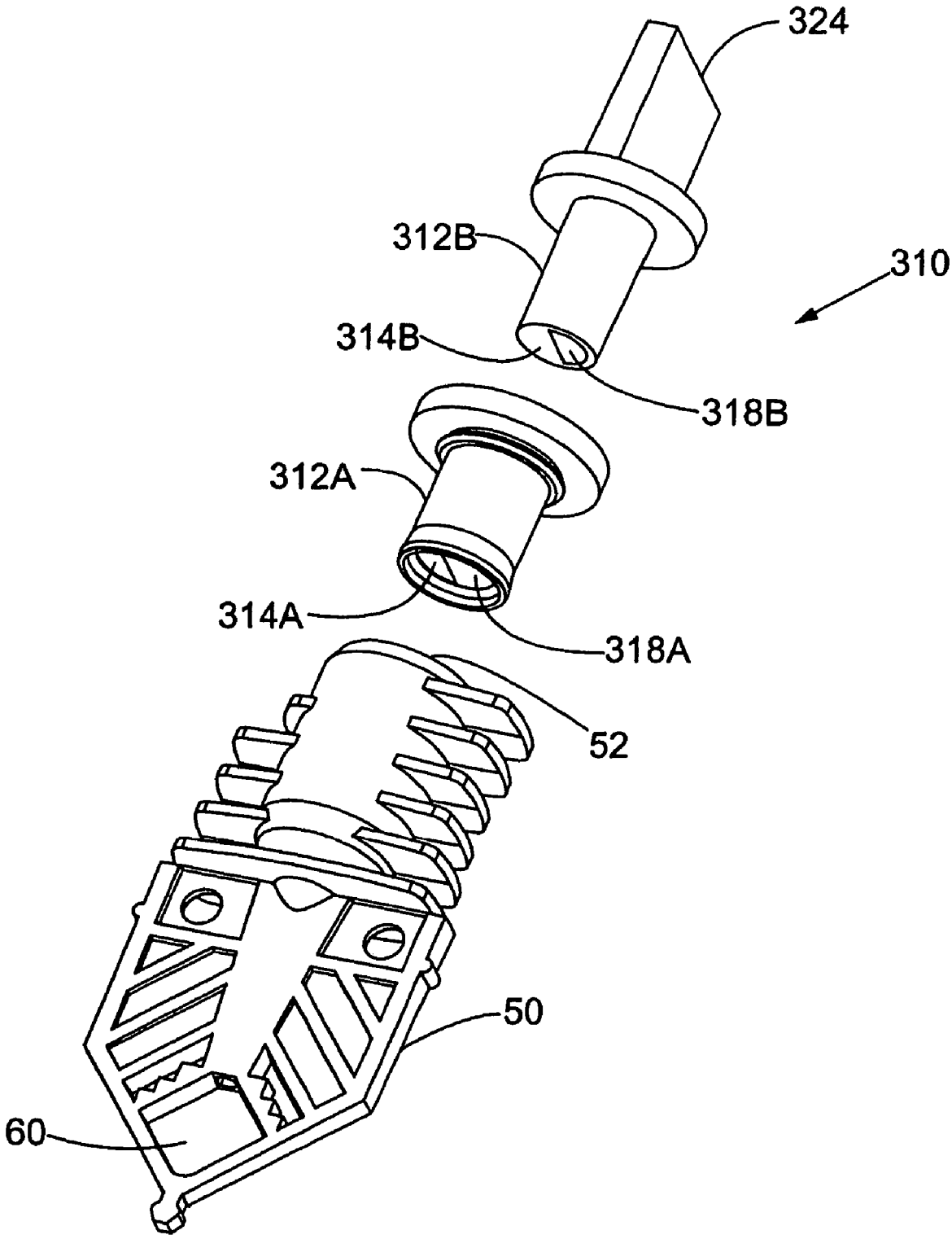
FIG. 23 is an exploded perspective view of a cap for a vessel according to another embodiment of the invention.
Figure 24:
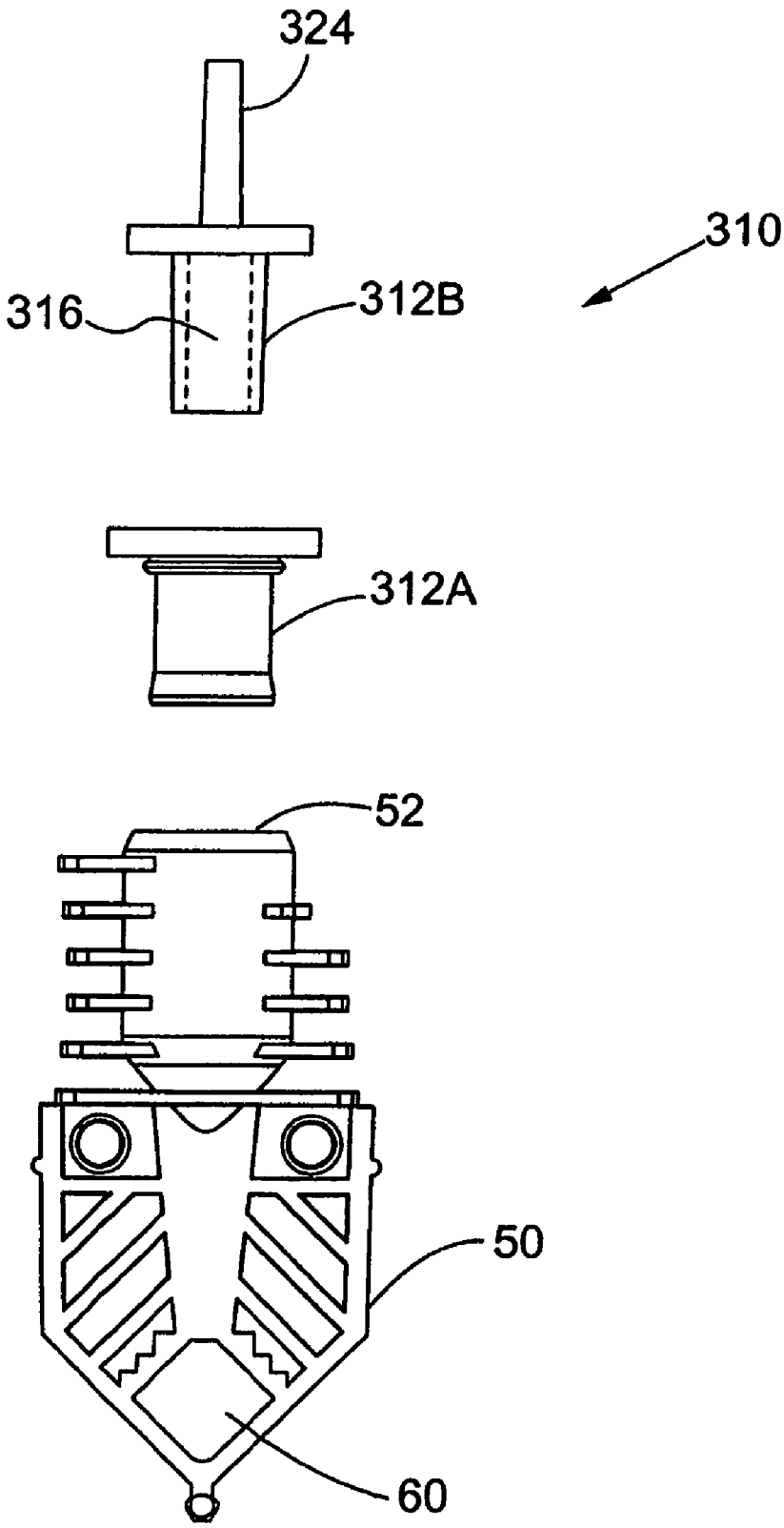
FIG. 24 is an exploded front view of the cap and vessel of FIG. 23.

FIGS. 23-24 show another embodiment of the invention. A cap 310 has a body comprising a cylindrical base portion 312A and an inserted portion 312B (shown exploded from base portion 312A in FIGS. 23-24) that is configured to be inserted into the base portion 312A. The base portion 312A is configured to be inserted into the port 52 of the vessel 50. The base portion has a bottom wall 314A having a first opening 318A therein. Similarly, the inserted portion 312B has a bottom wall 314B having a second opening 318B therein. A cap cavity 316 is disposed in the inserted portion 312B. When the inserted portion 312B is inserted into the base portion 312A, the inserted portion 312B is rotatably adjustable with respect to the base portion 312B to control whether the cap cavity 316 is fluidicly isolated from the vessel interior 60 (the first stage position) or fluidicly coupled to the vessel interior 60 (the second stage position). Preferably there is a knob 324 on top of the inserted portion 312B for rotating or twisting the inserted portion 312B. The control of the cap cavity is achieved by twisting the inserted portion 312B so that there is no alignment or overlap of openings 318A and 318B in the first stage position so that bottom walls 314A and 314B combine to provide a closed bottom to the cap 310. To move the cap 310 to the second stage position, the inserted portion 312B is rotated until the openings 318A and 318B are at least partially aligned so that they provide a hole in the bottom of the cap 310 and the cap cavity 316 is fluidicly coupled to the vessel interior 60.

The cap 310 is used to perform a two-stage process for analyzing a sample for the presence of one or more nucleic acids under closed conditions. A sample to be analyzed in the multi-stage reaction is introduced into the vessel interior 60 via the port 52 by a tube, syringe, pipette, or the like. The sample may be mixed with first stage reagents for performing the first stage of the multi-stage reaction prior to being placed in the vessel interior 60 or the sample may be mixed with the first stage reagents in the vessel interior 60. The inserted portion 312B is inserted into the base portion 312A and rotated to a reagent loading position in which the openings 318A and 318B are aligned. Second stage reagents for performing a second stage reaction are placed in the cap cavity 316 through the openings 318A and 318B. The inserted portion 312B is then twisted until the openings 318A and 318B are no longer aligned and do not overlap so that the bottom walls 314A and 314B combine to provide a temporarily closed bottom to the cap 310. The base portion 312A of the cap 310 is inserted into the port 52 of the vessel 50 to enclose the vessel interior 60. In this first-stage position in which the openings 318A and 318B are not aligned and the cap cavity 316 is fluidicly isolated from the vessel interior 60, the first stage reaction is conducted in the vessel interior 60, such as a first stage of a nested PCR or a reverse transcription reaction that is the first stage of an RT-PCR.

After the first stage reaction is conducted, the cap 310 is moved to the second stage position in which the cap cavity is fluidicly coupled to the vessel interior 60 by twisting the inserted portion 312B until the openings 318A and 318B are aligned. This releases the second stage reagents into the vessel interior 60 in the second-stage position. The vessel 50 is typically placed in a spinner or centrifuge apparatus to mix the second stage reagents with the reaction product of the first stage reaction in the vessel interior 60. The vessel 50 can then be used to run the second stage reaction, such as a second stage PCR reaction in the closed vessel interior 60, by coupling the vessel 50 to a temperature control system (e.g., a thermal cycler). The vessel interior 60 remains closed to the outside environment during the transition from the first-stage position to the second-stage position so that there is no contamination.

The caps described above can be made from any suitable material using any suitable process. In one embodiment, the cap is molded from a plastic material using injection molding or the like. For those configurations that employ the removable stop, the removable stop is formed separately, such as by molding from a plastic material.

It is to be understood that the above description is intended to be illustrative and not restrictive. Many embodiments will be apparent to those of skill in the art upon reviewing the above description. For example, in one alternative embodiment, the second stage reagents are not added to the cap cavity until after the first stage reaction is completed. The second stage reagents are thus not exposed to temperatures required for the first stage reaction. These and many other embodiments are possible. The scope of the invention should, therefore, be determined not with reference to the above description, but instead should be determined with reference to the appended claims alone with their full scope of equivalents.

What is claimed is:

1. A multi-stage process for reacting a sample in a vessel, wherein the vessel is configured to receive a cap to enclose the vessel interior, the cap comprising:

i) a body having a cap cavity, ii) a spike cap portion connected to the body by a spike cap arm, the spike cap portion comprising a closed top and a spike with a sharp distal end, and iii) a driver cap portion comprising a bearing surface, wherein the driver cap portion is connected by a driver cap arm to an upper wall that extends upward from the body, the upper wall being open in the region where the spike cap arm connects to the body, wherein the driver cap arm is disposed opposite that of the spike cap arm, and wherein the cap is adjustable between a first stage position in which the cap cavity is fluidicly isolated from the vessel interior, and a second stage position in which the cap cavity is fluidicly coupled with the vessel interior, the method comprising the steps of:

a) providing in the vessel interior a sample mixed with first stage reagents for conducting a first stage reaction;

b) mating the cap to the vessel to enclose the vessel interior;

c) conducting the first stage reaction with the sample and first stage reagents in the vessel interior, wherein the first stage reaction is conducted with the cap in the first stage position in which the cap cavity is fluidicly isolated from the vessel interior;

d) adding second stage reagents stored in the cap cavity to the reaction product of the first stage reaction, wherein the second stage reagents are added by moving the cap into the second stage position in which the cap cavity is fluidicly coupled with the vessel interior and mixing the second stage reagents with the reaction product of the first stage reaction; and e) conducting a second stage reaction in the vessel interior with the reaction product of the first stage reaction and the second stage reagents.

2. The process of claim 1, wherein the cap cavity disposed in the body is defined by a closed bottom and an open top, wherein the closed bottom encloses the vessel interior and fluidicly isolates the cap cavity from the vessel interior in the first-stage position.

3. The process of claim 2, wherein the step of moving the cap to the second stage position comprises penetrating the closed bottom with the spike to fluidicly couple the cap cavity with the vessel interior.

4. The process of claim 3 wherein, in the first stage position, the spike is disposed in the cap cavity without penetrating the closed bottom and the spike top portion encloses the cap cavity.

5. The process of claim 3, wherein the step of penetrating the closed bottom with the spike comprises pressing the bearing surface of the driver cap portion of the cap against the top of the spike cap portion.

6. The process of claim 1, further comprising the step of placing the second stage reagents in the cap cavity after inserting the body of the cap into a port of the vessel.

7. The process of claim 1 wherein the first-stage reaction comprises a first-stage polymerase chain reaction and the second-stage reaction comprises a second-stage polymerase chain reaction.

8. The process of claim 1, wherein the first and second stage reactions are the first and second stage reaction of a nested polymerase chain reaction process.

9. The process of claim 1, wherein the first-stage reaction comprises a reverse transcription reaction, and wherein the second stage reaction comprises a polymerase chain reaction.

10. The process of claim 1, wherein the second stage reagents are stored in the cap in dried or lyophilized form.

11. The process of claim 1, wherein the mixing step comprises spinning or centrifuging the vessel and cap.

12. The process of claim 1, wherein the mixing step comprises shaking the vessel and cap.

* * * * *

UNITED STATES PATENT AND TRADEMARK OFFICE

CERTIFICATE OF CORRECTION

PATENT NO. : 7,621,418 B2
APPLICATION NO. : 11/304798
DATED : November 24, 2009
INVENTOR(S) : Ronald Chang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 346 days.

Signed and Sealed this

Twenty-sixth Day of October, 2010

David J. Kappos

David J. Kappos
*Director of the United States Patent and Trademark Office*